US008333246B2

(12) United States Patent
Hanratty et al.

(10) Patent No.: US 8,333,246 B2
(45) **Date of Patent: *Dec. 18, 2012**

(54) HYDRO-PNEUMATIC EXTINGUISHER

(75) Inventors: Michael P. Hanratty, Remsenburg, NY (US); Peter C. Hanratty, Speonk, NY (US); David G. Horton, Remsenburg, NY (US)

(73) Assignee: Hanratty Associates, Yaphank, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/985,818

(22) Filed: Jan. 6, 2011

(65) Prior Publication Data

US 2011/0290510 A1 Dec. 1, 2011

Related U.S. Application Data

(60) Provisional application No. 61/348,109, filed on May 25, 2010.

(51) Int. Cl.
*A62C 11/00* (2006.01)

(52) U.S. Cl. ..... 169/33; 169/71; 169/73; 169/85; 169/9; 169/13; 239/332

(58) Field of Classification Search ..... 169/9, 13, 169/18, 33, 71, 73, 85; 239/332
See application file for complete search history.

(56) References Cited

U.S. PATENT DOCUMENTS

| | | | | |
|---|---|---|---|---|
| 1,104,079 | A * | 7/1914 | Snyder | 169/73 |
| 2,710,227 | A | 6/1955 | Huthsing | |
| 2,856,010 | A * | 10/1958 | Brill et al. | 169/9 |
| 2,960,369 | A * | 11/1960 | Goldie | 406/146 |
| 5,205,306 | A | 4/1993 | Peterson | |
| 5,984,016 | A * | 11/1999 | Samuelsson | 169/62 |
| 7,201,383 | B2 | 4/2007 | Gibby | |
| 2004/0123991 | A1 | 7/2004 | Hanratty | |
| 2004/0216896 | A1 | 11/2004 | Hanratty | |
| 2009/0166358 | A1 | 7/2009 | Bose | |

FOREIGN PATENT DOCUMENTS

| | | |
|---|---|---|
| WO | WO 2009/056574 | 5/2009 |

OTHER PUBLICATIONS

Fogmaker® Universal Installation Manual. Manual [online]. Fogmaker International AB. Apr. 6, 2009 Retrieved from the Internet: <URL: http://www.fogmaker.com/ .../8010-002%20Installation%20manual%202008%20ENG%20final.pdf.

PCT International Search Report and Written Opinion dated Sep. 2011.

U.S. Appl. No. 61/348,109, filed May 2010.

* cited by examiner

*Primary Examiner* — Dinh Q Nguyen

(74) *Attorney, Agent, or Firm* — McCarter & English, LLP

(57) ABSTRACT

The present disclosure provides for an advantageous extinguisher or discharge assembly. In exemplary embodiments, the present disclosure provides for an improved hydro-pneumatic fire extinguisher or discharge assembly. More particularly, the present disclosure provides for an improved hydro-pneumatic fire extinguisher or discharge assembly that is configured and dimensioned to fire or release a fire fighting agent (e.g., a fluid and/or liquid based fire fighting agent) while the extinguisher/assembly is oriented in any position or angle relative to gravity.

16 Claims, 9 Drawing Sheets

HYDRO-PNEUMATIC EXTINGUISHER

CROSS REFERENCE TO RELATED APPLICATIONS

This application claims the benefit of U.S. Provisional App. Ser. No. 61/348,109, filed May 25, 2010, the entire contents of which is herein incorporated by reference in its entirety.

BACKGROUND

1. Technical Field

The present disclosure relates to an extinguisher or discharge assembly and, more particularly, to a hydro-pneumatic fire extinguisher or discharge assembly.

2. Background Art

In general, the use of extinguishers or discharge assemblies to fight fires and the like are known. Fire extinguishers are useful in a myriad of different environments (e.g., for commercial, industrial, military and/or residential applications). However, conventional traditional cylinder based fire extinguishers generally will only operate properly if the cylinder is held in an substantially upright position relative to gravity. For example, the cylinder or housing of conventional extinguishers typically contains an internal dip tube which generally runs to the bottom of the cylinder or housing. The contents of the cylinder are typically pressurized (e.g., via pressurized air) at the top of the container. When the extinguisher is fired, the pressurized fire fighting fluid or agent generally gets pushed or forced up through the dip tube and released from the valve. However, if the cylinder is in a position other than substantially upright (e.g., relative to gravity), the pressurized air gets introduced into the dip tube (which allows the pressurized air to be released) but not the fire fighting fluid or agent, which ultimately renders the extinguisher inoperable.

Such a result is highly undesirable in many situations when a user desires to utilize an extinguisher to fight a fire. For example, military vehicles in combat zones are susceptible to attacks and/or fire from many sources (e.g., enemy fire, improvised explosive devices, etc.). Moreover, military vehicles that have been attacked and/or hit by an improvised explosive device often tip and/or flip over, resulting in the cylinders of the extinguishers being carried by such military vehicles (and/or carried by the personnel in the vehicles) to be in a position other than substantially upright relative to gravity. As such, these conventional extinguishers whose cylinders that are now in a position other than substantially upright will not operate properly, as the pressurized air gets introduced into the dip tube but not the fire fighting fluid or agent, which ultimately renders the extinguishers inoperable.

Thus, despite efforts to date, a need remains for improved and efficient extinguishers or discharge assemblies that will fire or release a fire fighting agent while the cylinder or housing of the extinguisher or discharge assembly is oriented in any position or angle relative to gravity. These and other inefficiencies and opportunities for improvement are addressed and/or overcome by the assemblies, systems and methods of the present disclosure.

SUMMARY

The present disclosure provides for an advantageous extinguisher or discharge assembly. In exemplary embodiments, the present disclosure provides for an improved hydro-pneumatic fire extinguisher or discharge assembly. More particularly, the present disclosure provides for an improved hydro-pneumatic fire extinguisher or discharge assembly that is configured and dimensioned to fire or release a fire fighting agent (e.g., a fluid and/or liquid based fire fighting agent) while the cylinder or housing of the extinguisher or discharge assembly is oriented in substantially any position or angle relative to gravity.

Exemplary extinguishers or discharge assemblies of the present disclosure are configured for carrying and discharging a fire extinguishing agent (e.g., a fluid based fire fighting agent) under extreme environmental conditions (e.g., mounted in a military vehicle or the like and actuated via an electronic sensor and/or a manual switching system). The extinguishers/assemblies also function as a self-contained portable fire extinguisher. The extinguishers can be sized to fit specific applications.

In one embodiment, the extinguisher or discharge assembly includes a traveling actuator (e.g., a traveling piston) contained within a housing or cylinder, with the housing or cylinder having dual pressure chambers. Thus, unlike conventional extinguishers, the exemplary extinguishers of the present disclosure are adapted and dimensioned to release a fire fighting agent (e.g., fluid based) from the extinguisher/housing, while the extinguisher/housing is configured or oriented in any position or angle relative to gravity.

The present disclosure provides for a discharge assembly including a housing having a body portion having a first end and a second end; an actuator within the housing, the actuator configured and dimensioned to fluidically separate the housing into a first chamber and a second chamber, the first chamber configured to house a fire fighting agent and the second chamber configured to house a pressurized fluid; a first end member enclosing the first end of the housing and having an outlet in fluid communication with a first valve, the first valve configured to allow: (i) the first chamber to be filled with the fire fighting agent, and (ii) at least a portion of the fire fighting agent to be released via the first valve when actuated; an actuating member mounted with respect to the first valve; a second valve in fluid communication with the second chamber, the second valve configured to pressurize the fluid housed in the second chamber; wherein upon actuation of the actuating member, the actuating member causes the first valve to open, thereby allowing for the release of the fire fighting agent from the first chamber and through the outlet and to the first valve, and the housed fluid pressure in the second chamber moves the actuator towards the first chamber, thereby forcing at least a portion of the fire fighting agent out of the first chamber and through the first valve.

The present disclosure also provides for a discharge assembly wherein the body portion of the housing is substantially cylindrical; and wherein the housing further includes a top extension portion that extends: (i) above the body portion, and (ii) at least partially around the circumference of the substantially cylindrical body portion, the top extension portion including a handle slot and a view hole.

The present disclosure also provides for a discharge assembly wherein the actuator is a traveling piston fabricated from aluminum or ultra high molecular weight polyurethane. The present disclosure also provides for a discharge assembly wherein the first end member includes at least one first groove configured to house a first gasketing material that forms a seal between the first end member and the housing; and wherein the actuator includes at least one second groove configured to house a second gasketing material that forms a seal between the actuator and the housing.

The present disclosure also provides for a discharge assembly wherein the fire fighting agent is a fluid based fire fighting solution; and wherein the pressurized fluid is selected from the group consisting of compressed gas, air or nitrogen. The present disclosure also provides for a discharge assembly wherein at least a portion of the fire fighting agent is forced out of the first chamber regardless of the position of the housing relative to gravity. The present disclosure also provides for a discharge assembly wherein at least a portion of the fire fighting agent is forced out of the first chamber while the housing is oriented in any position or angle relative to gravity.

The present disclosure also provides for a discharge assembly wherein the actuator includes a recessed area configured to increase the volume of the second chamber. The present disclosure also provides for a discharge assembly wherein the second valve is a Schrader valve; and wherein the pressurized fluid in the second chamber is pressurized to about 300 psi prior to actuating the actuating member.

The present disclosure also provides for a discharge assembly wherein the first chamber is configured to house about two gallons of the fire fighting agent prior to actuating the actuating member. The present disclosure also provides for a discharge assembly wherein the housing includes an interior protrusion, the interior protrusion configured and dimensioned to allow the actuator to rest thereon prior to actuating the actuating member. The present disclosure also provides for a discharge assembly further including a rod and a rod stop configured and dimensioned to allow the actuator to rest thereon prior to actuating the actuating member.

The present disclosure also provides for a discharge assembly wherein the actuating member is a pneumatic actuator. The present disclosure also provides for a discharge assembly wherein the actuating member further includes a handle member, the handle member configured to allow a user to manually actuate the actuating member by rotating the handle member.

The present disclosure also provides for a discharge assembly further including an electric solenoid member in communication with the actuating member and in electrical communication with a switch and a sensor, the electric solenoid member configured to: (i) allow a user to actuate the actuating member by manually moving the switch, or (ii) actuate the actuating member when the sensor determines that a certain condition has been reached.

The present disclosure also provides for a discharge assembly wherein the actuating member further includes manual switching means, the actuating member configured to be manually actuated via the manual switching means; and wherein the actuating member is in electrical communication with sensor means, the actuating member configured to be actuated via the sensor means. The present disclosure also provides for a discharge assembly wherein the actuating member is configured to be manually or remotely actuated.

The present disclosure also provides for a discharge assembly further including a nozzle in fluid communication with the first valve, the nozzle configured and dimensioned to: (i) discharge the fire fighting agent of the first chamber from the nozzle for fire fighting purposes after the actuating member has been actuated, or (ii) be fluidically and releasably mounted with respect to a spray assembly to allow the fire fighting agent of the first chamber to travel through the nozzle and to the spray assembly for fire fighting purposes after the actuating member has been actuated.

The present disclosure also provides for a discharge assembly wherein the nozzle is a quick disconnect nozzle. The present disclosure also provides for a discharge assembly wherein the spray assembly is a spray ring, the spray ring including at least one spray nozzle. The present disclosure also provides for a discharge assembly wherein the housing is configured to be releasably mounted with respect to a vehicle or building; and wherein the spray assembly is configured to be mounted with respect to the vehicle or building.

The present disclosure also provides for a discharge assembly wherein the housing further includes a pressure release port; and wherein when the actuator is at the top of its stroke and positioned at or near the first end member at the first end of the housing, the pressure release port is uncovered, thereby allowing substantially any remaining pressurized fluid in the housing to release therethrough, which thereby forces substantially any remaining fire fighting agent in the first chamber out through the first valve.

The present disclosure also provides for a discharge assembly including a substantially cylindrical housing having a first end and a second end; a traveling piston within the housing, the traveling piston configured and dimensioned to fluidically separate the housing into a first chamber and a second chamber, the first chamber configured to house a fire fighting agent and the second chamber configured to house a pressurized fluid; a first end member enclosing the first end of the housing and having an outlet in fluid communication with a first valve, the first valve configured to allow: (i) the first chamber to be filled with the fire fighting agent, and (ii) at least a portion of the fire fighting agent to be released via the first valve when actuated; a pneumatic actuator mounted with respect to the first valve; a second valve in fluid communication with the second chamber at the second end of the housing, the second valve configured to pressurize the fluid housed in the second chamber; wherein upon actuation of the pneumatic actuator, the pneumatic actuator causes the first valve to open, thereby allowing for the release of the fire fighting agent from the first chamber and through the outlet and to the first valve, and the housed fluid pressure in the second chamber moves the traveling piston towards the first chamber, thereby forcing at least a portion of the fire fighting agent out of the first chamber and through the first valve; and wherein at least a portion of the fire fighting agent is forced out of the first chamber regardless of the position of the housing relative to gravity.

The present disclosure also provides for a discharge assembly including a housing having a body portion having a first end and a second end; an actuator within the housing, the actuator configured and dimensioned to fluidically separate the housing into a first chamber and a second chamber, the first chamber configured to house a fire fighting agent and the second chamber configured to house a pressurized fluid; a first end member enclosing the first end of the housing and having an outlet in fluid communication with a first valve, the first valve configured to allow: (i) the first chamber to be filled with the fire fighting agent, and (ii) at least a portion of the fire fighting agent to be released via the first valve when actuated; an actuating member mounted with respect to the first valve, the actuating member configured to be manually or remotely actuated; a second valve in fluid communication with the second chamber, the second valve configured to pressurize the fluid housed in the second chamber; a nozzle in fluid communication with the first valve, the nozzle configured and dimensioned to: (i) discharge the fire fighting agent of the first chamber from the nozzle for fire fighting purposes after the actuating member has been actuated, or (ii) be fluidically and releasably mounted with respect to a spray assembly to allow the fire fighting agent of the first chamber to travel through the nozzle and to the spray assembly for fire fighting purposes after the actuating member has been actuated; wherein the housing includes an interior protrusion, the interior protrusion configured and dimensioned to allow the actuator to rest thereon prior to actuating the actuating member; wherein upon actuation of the actuating member, the actuating member causes the first valve to open, thereby allowing for the release of the fire fighting agent from the first chamber and through the outlet and to the first valve, and the housed fluid pressure in the second chamber moves the actuator towards the first chamber, thereby forcing at least a portion of the fire fighting agent out of the first chamber and through the first valve; and wherein at least a portion of the fire fighting agent is forced out of the first chamber regardless of the position of the housing relative to gravity.

Additional advantageous features, functions and applications of the disclosed assemblies, systems and methods of the present disclosure will be apparent from the description which follows, particularly when read in conjunction with the appended figures.

BRIEF DESCRIPTION OF THE DRAWINGS

To assist those of ordinary skill in the art in making and using the disclosed assemblies, systems and methods, reference is made to the appended figures, wherein.

DETAILED DESCRIPTION

Figure 1:
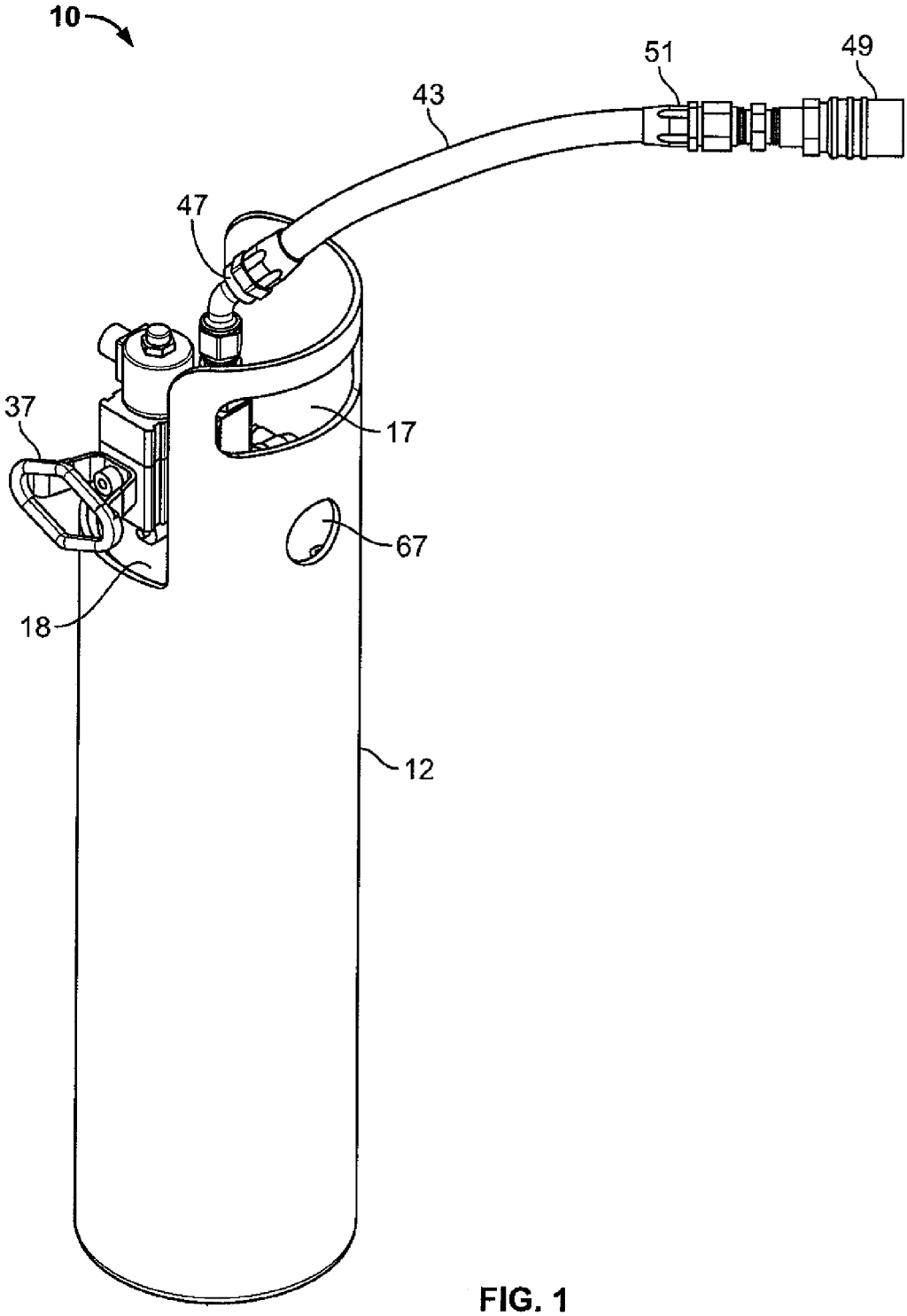
FIG. 1 is a side perspective view of an exemplary extinguisher or discharge assembly according to the present disclosure.

In the description which follows, like parts are marked throughout the specification and drawings with the same reference numerals, respectively. Drawing figures are not necessarily to scale and in certain views, parts may have been exaggerated for purposes of clarity.

The present disclosure provides for an advantageous extinguisher or discharge assembly. In exemplary embodiments, the present disclosure provides for an improved hydro-pneumatic fire extinguisher discharge assembly. More particularly, the present disclosure provides for an improved hydro-pneumatic fire extinguisher or discharge assembly that is configured and dimensioned to fire or release a fire fighting agent (e.g., a fluid and/or liquid based fire fighting agent) while the housing or cylinder of the extinguisher is oriented in substantially any position or angle relative to gravity.

In exemplary embodiments, the extinguisher or discharge assembly includes a traveling actuator (e.g., a traveling piston) contained within a housing (e.g., a cylindrical housing), with the housing having dual pressure chambers. Thus, unlike conventional extinguishers, the exemplary extinguishers of the present disclosure are adapted and dimensioned to release a fluid based fire fighting agent from the extinguisher/housing while the extinguisher/housing is configured or oriented in any position or angle relative to gravity.

Current practice provides that conventional traditional cylinder based fire extinguishers generally will only operate properly if the cylinder is held in an substantially upright position relative to gravity. For example, if the cylinder of such a conventional extinguisher is in a position other than substantially upright, the pressurized air gets introduced into the dip tube but not the fire fighting fluid or agent, which ultimately renders the extinguisher inoperable. Such a result leads to many undesired results. For example, military vehicles in combat zones are susceptible to attacks and/or fire from many sources, and military vehicles that have been attacked and/or hit (e.g., by an improvised explosive device) often tip and/or flip over, resulting in the cylinders of the extinguishers being carried by such military vehicles to be in a position other than substantially upright relative to gravity. As such, these conventional extinguishers whose cylinders that are now in a position other than substantially upright will not operate properly.

In exemplary embodiments, the present disclosure provides for an improved extinguisher or discharge assembly that is configured to fire or release a fire fighting agent while the housing or cylinder of the extinguisher is oriented in any position or angle relative to gravity, thereby providing a significant commercial and/or operational advantage as a result. For example, the exemplary extinguishers of the present disclosure are configured for carrying and discharging a fire extinguishing agent (e.g., a fluid) under extreme environmental conditions, including military combat or the like. As such, the improved extinguishers may be mounted in a vehicle and actuated via an electronic sensor or the like and/or a manual switching system. The extinguishers also function as a self-contained portable fire extinguisher. Moreover, the exemplary extinguishers of the present disclosure can be sized to fit specific applications (e.g., military, commercial and/or residential applications).

Figure 2:
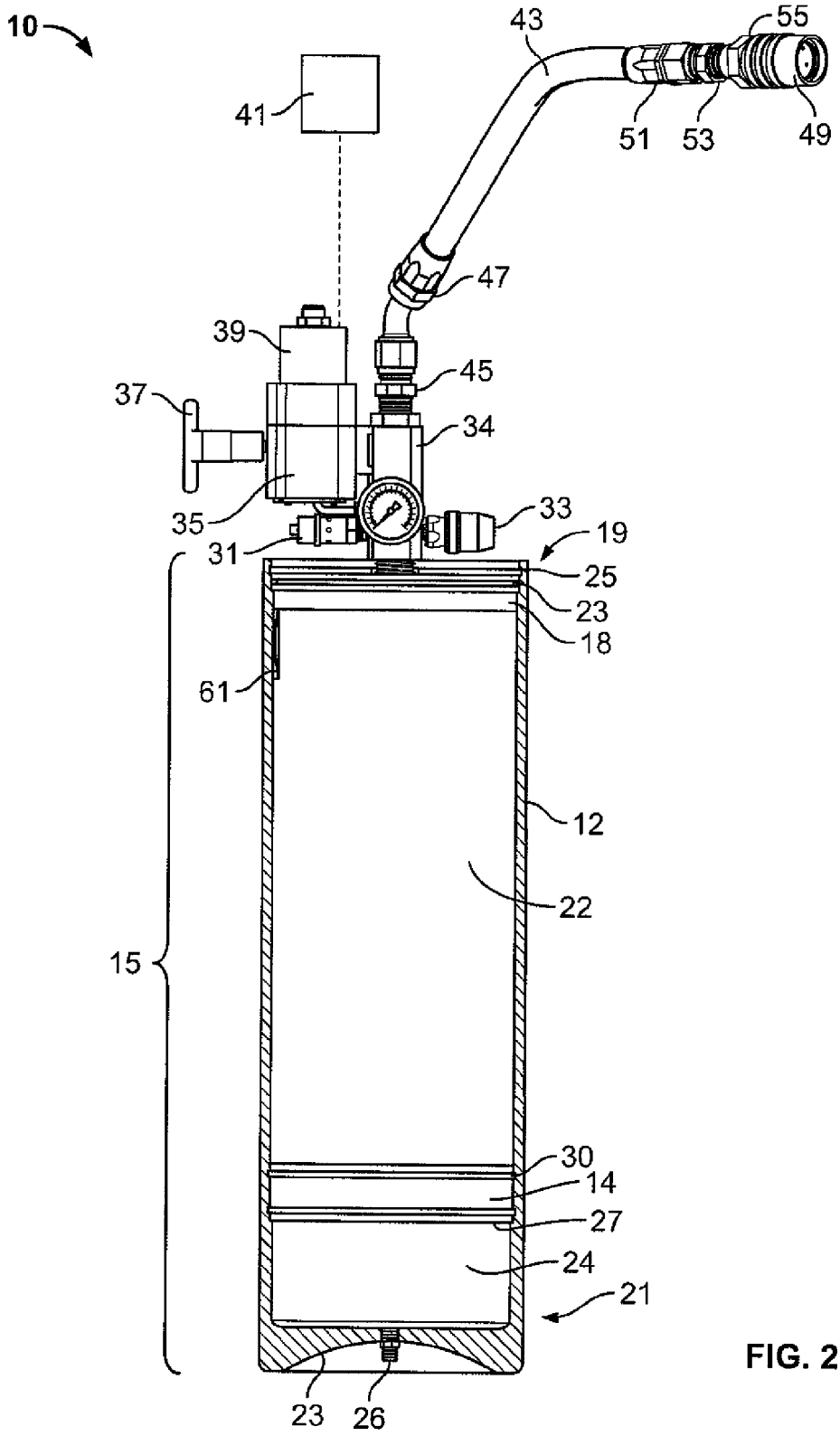
FIG. 2 is a side view of the assembly of FIG. 1 showing the body portion of the assembly in cross-section and with the top extension portion of the housing removed.

Referring now to the drawings, and in particular to FIGS. 1-2, there is illustrated an extinguisher or discharge assembly 10 depicting an exemplary embodiment of the present disclosure. Exemplary extinguisher/discharge assembly 10 takes the form of a substantially cylindrical or substantially cylinder-based extinguisher or discharge assembly 10, although the present disclosure is not limited thereto. Rather, extinguisher/discharge assembly 10 may take a variety of forms. In exemplary embodiments of the present disclosure and as further discussed below, extinguisher/discharge assembly 10 is a hydro-pneumatic fire extinguisher that is configured and dimensioned to fire or release a fire fighting agent (e.g., a fluid and/or liquid based fire fighting agent) while the housing or cylinder 12 of extinguisher 10 is oriented in any position or angle relative to gravity (e.g., relative to the ground). In one embodiment, extinguisher/discharge assembly 10 is configured to house and/or contain about 2 gallons of fire fighting agent (e.g., a fluid based fire fighting agent and/or solution).

In exemplary embodiments and as shown in FIGS. 1-9, extinguisher/assembly 10 typically includes housing 12, with housing 12 configured and dimensioned to house and/or contain actuator 14. In an exemplary embodiment, housing 12 is a substantially cylinder-based or a substantially cylindrical housing fabricated from 6061 aluminum extruded (e.g., impact extruded) pipe or the like, although the present disclosure is not limited thereto. It is noted that extinguisher/discharge assembly 10 may take a variety of forms, and may be fabricated from a variety of materials. In general, housing 12 typically includes a top extension portion 13 that extends above substantially cylindrical body portion 15 of housing 12, with top extension portion 13 typically including a user-friendly handle slot 17 and a user-friendly view hole 67 (e.g., a gauge view hole). Top extension portion 13 typically extends at least partially (e.g., about half-way) around the circumference of substantially cylindrical body portion 15 of housing 12, as depicted in FIG. 1.

In exemplary embodiments, housing 12 also includes a first end member 18. As shown in FIGS. 1-5, first end member 18 is typically configured and dimensioned to enclose or seal (e.g., fluidically seal) a first end 19 of body portion 15 of housing 12. Second end 21 of body portion of housing 12 is typically integrally closed or sealed by housing 12, although the present disclosure is not limited thereto. Second end 21 typically includes an interior concave portion 23, as further discussed below.

In exemplary embodiments, first end member 18 is substantially cylindrical (e.g., an O-ringed based and/or a threaded cylinder end cap), and is typically fabricated from 6061 aluminum or the like. In one embodiment, first end member 18 is an O-ring based cylinder end cap or the like, with first end member 18 having at least one groove or slot that is configured and dimensioned to house at least one gasketing material 23 (e.g., an O-ring) or the like. Gasketing material 23 is configured to form a seal (e.g., a fluid-tight seal) between the first end member 18 and the first end 19 of housing 12. In exemplary embodiments, first end member 18 includes two grooves or slots that each contain a gasketing material 23 (e.g., two separate O-rings). First end member is also typically held into place at or near first end 19 via retaining member 25 (e.g., retaining ring 25).

In an alternative embodiment, first end member 18 is a threaded cylinder end cap or the like, and the threads of first end member 18 are configured to threadably engage with housing threads positioned or located at or near first end 19 of housing 12.

In general, actuator 14 housed within housing 12 is a traveling piston or the like, such as, for example, an aluminum (e.g., 6061 aluminum) or an ultra high molecular weight polyurethane traveling piston 14, although the present disclosure is not limited thereto. Actuator 14 (e.g., traveling piston head) may take a variety of forms, and may be fabricated from a variety of materials.

Figure 3:
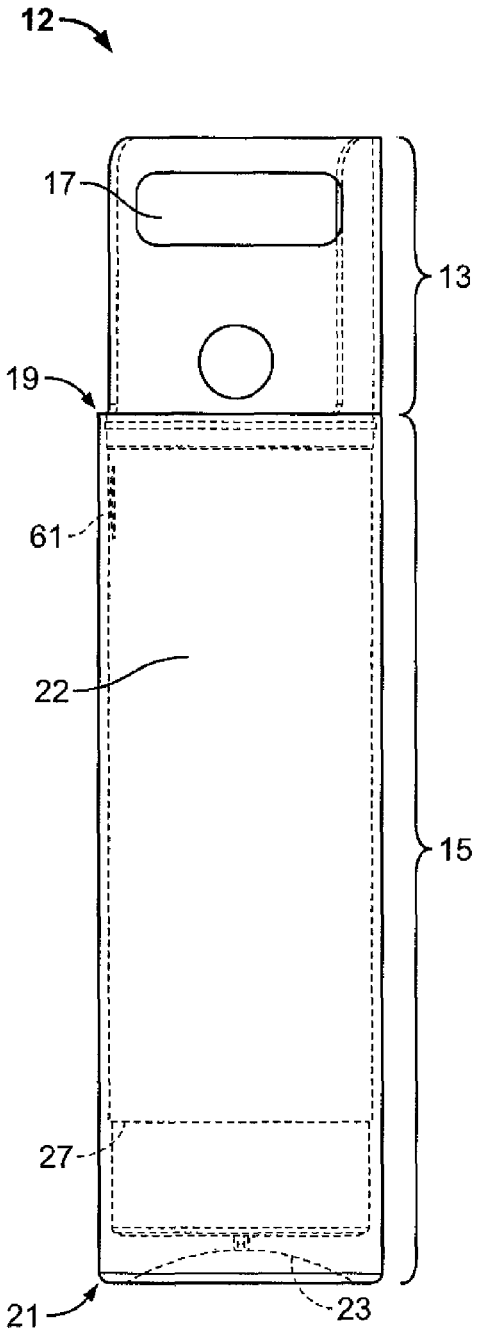
FIG. 3 is a side view of the housing of the assembly of FIG. 1.
Figure 4:
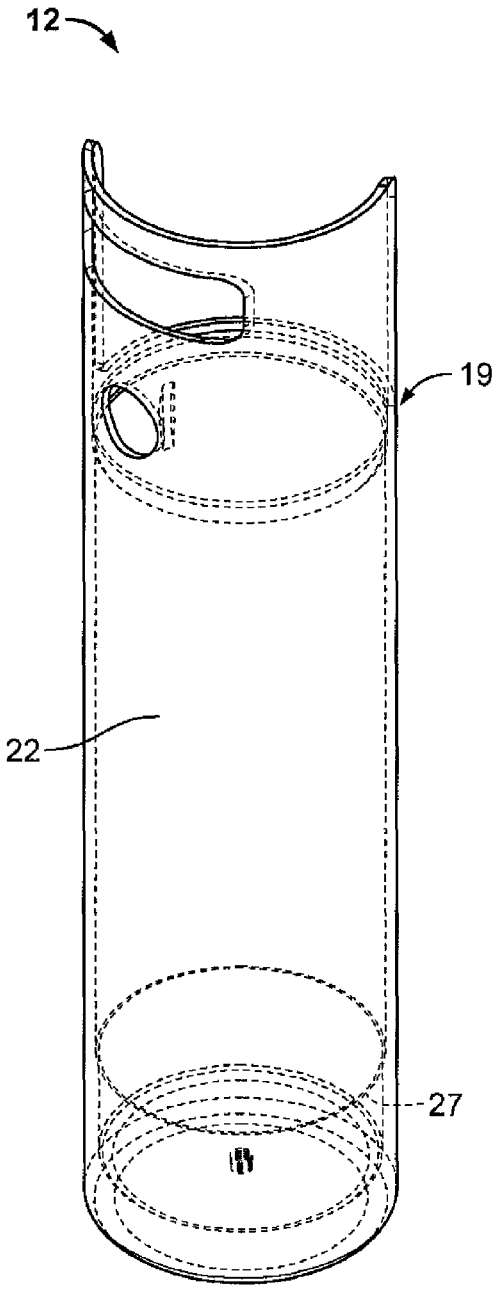
FIG. 4 is a side perspective view of the housing of the assembly of FIG. 1.
Figure 5:
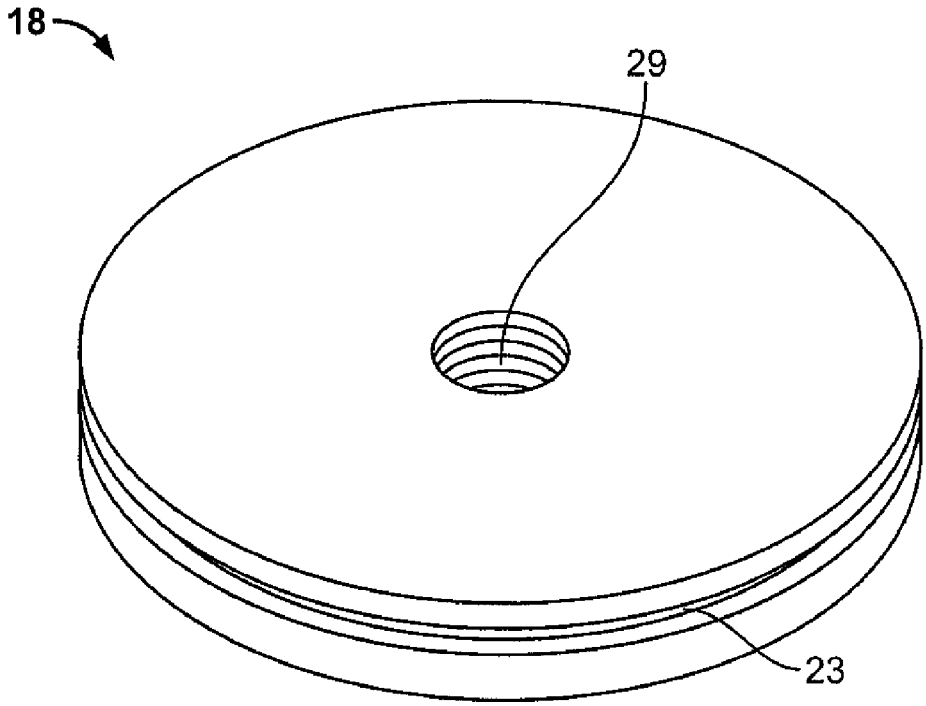
FIG. 5 is a side perspective view of the first end member of the assembly of FIG. 1.
Figure 6:
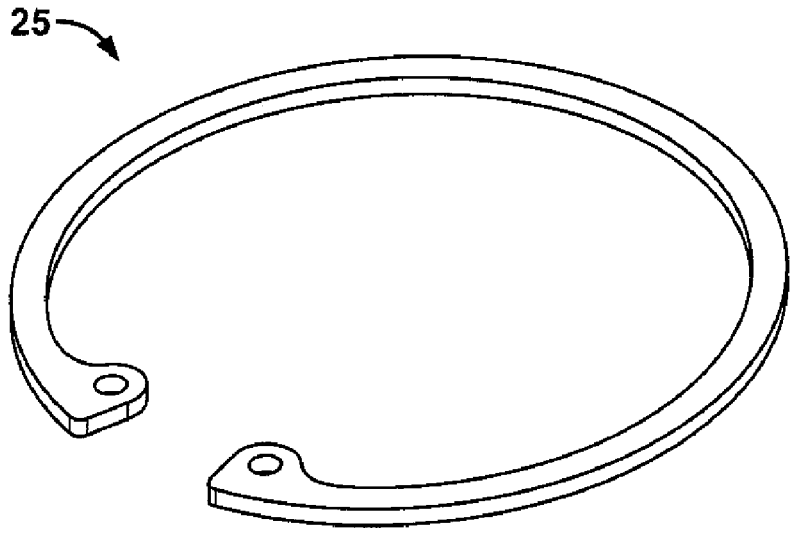
FIG. 6 is a side perspective view of the retaining member of the assembly of FIG. 1.

In exemplary embodiments and as shown in FIGS. 2-3, the interior of body portion 15 of housing 12 typically includes an interior protrusion, ledge, shoulder or lip 27 that is configured and dimensioned to allow actuator 14 to rest or sit thereon (e.g., when actuator is not being actuated). Stated another way, protrusion 27 is configured to halt the downward movement of actuator 14 (e.g., by engaging actuator 14). In exemplary embodiments and as shown in FIG. 4, protrusion 27 extends circumferentially around the lower part of the interior of body portion 15 of housing 12. In general and as further discussed below, protrusion 27 allows actuator 14 to fluidically separate housing 12 into two distinct fluid or pressure chambers 22 and 24. Protrusion or lip 27 may be an integral protrusion or lip (i.e., integral with the interior of housing 12). The protrusion or lip may also be mounted with respect to the interior of housing 12.

Alternatively, actuator 14 may include a dowel or rod 16 (e.g., cylindrical rod) and a dowel or rod stop, as discussed further below in conjunction with discharge assembly 100. In general, rod and a rod stop 16 are configured and dimensioned to allow the actuator 14 to rest thereon prior to actuating the actuating member 35.

Figure 7:
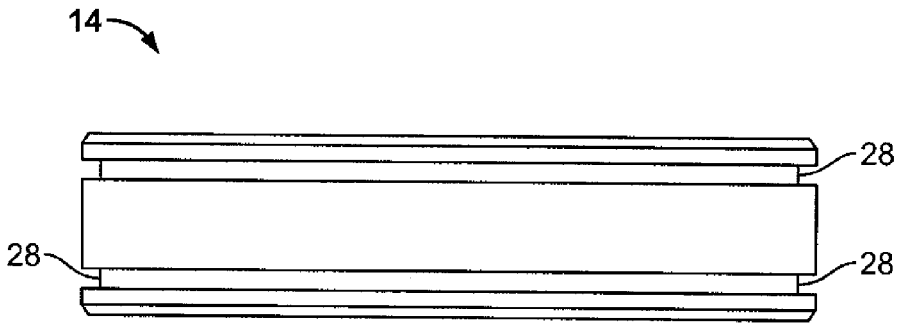
FIG. 7 is a partial side view of an exemplary actuator of an extinguisher according to the present disclosure.
Figure 8:
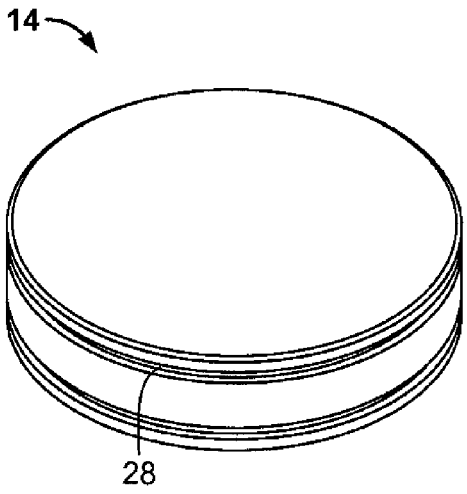
FIG. 8 is a partial top perspective view of the actuator of FIG. 7.
Figure 9:
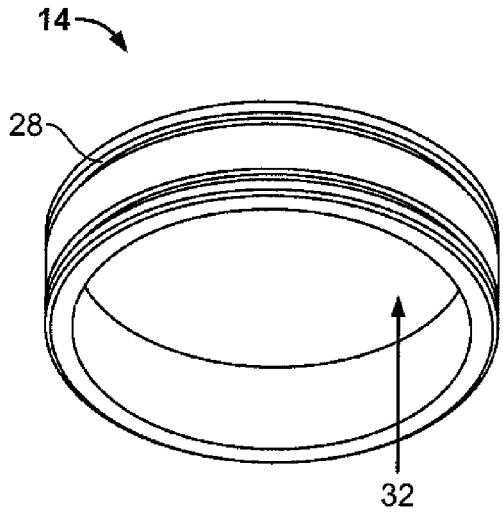
FIG. 9 is a partial bottom perspective view of the actuator of FIG. 7.

In exemplary embodiments, actuator 14 (e.g., traveling piston) is configured and dimensioned to separate the body portion 15 of housing 12 into two distinct fluid or pressure chambers 22 and 24 (e.g., prior to and during actuation of actuator 14). Stated another way and as shown in FIGS. 2-4, actuator 14 separates (e.g., fluidically separates) first chamber 22 of housing 12 from second chamber 24 of housing 12. In general and as shown in FIGS. 7-9, actuator 14 includes at least one groove or slot 28 that is configured and dimensioned to house a gasketing material 30 (e.g., an O-ring) to form an additional seal (e.g., fluid-tight seal) between the actuator 14 and the housing 12. In an exemplary embodiment and as depicted in FIG. 9, actuator 14 further includes a recessed area 32 to maximize or increase the volume of second chamber 24 (e.g., to maximize the volume of compressed gas or air in the second chamber 24, prior to and/or during actuation of actuator 14), while also providing support for actuator 14.

In general, first chamber 22 is configured to house and/or contain a fire fighting agent (e.g., a fluid or liquid-based fire fighting solution or agent or the like), prior to and/or during actuation of actuator 14. In one embodiment, first chamber 22 has a volume of about 462 cubic inches when actuator 14 is resting on or near protrusion 27.

Second chamber 24 is generally configured to house and/or contain a pressurized or compressed fluid or gas (e.g., pressurized or compressed air or nitrogen or the like), prior to and/or during actuation of actuator 14. In one embodiment, second chamber 24 has a volume of about 116 cubic inches when actuator 14 is resting on or near protrusion 27.

As shown in FIGS. 2-3, second chamber 24 typically is in communication (e.g., fluidic communication) with valve 26 (e.g., a ⅛ inch NPT Schrader valve). In general, at least a portion of valve 26 is positioned in concave portion 23 of housing 12. In one embodiment, when actuator 14 is resting on or near protrusion 27 and after first chamber 22 has been filled with fire fighting agent (as discussed below), the pressurized or compressed fluid contained in second chamber 24 is charged (e.g., to about 300 psi) via valve 26.

In exemplary embodiments, a valve 34 (e.g., a pressure or actuating valve 34, such as a ½ inch NPT pressure actuated brass ball valve with a quick disconnect fitting) with an associated port (e.g., ½ inch NPT female port) is mounted with respect to first end member 18 so that outlet 29 of first end member 18 is in fluidic communication with valve 34. Valve 34 typically includes or is associated with a safety pop-off or safety blow-off valve/member 31, and/or a pressure switch 33.

In general, valve 34 is configured to allow the first chamber 22 to be filled with fire fighting agent (e.g., liquid fire fighting solution or the like) and to allow the fire fighting agent to be released when extinguisher/assembly 10 is fired and/or actuated. Extinguisher/assembly 10 typically is fired and/or actuated via actuating member 35. Exemplary actuating member 35 takes the form of a pneumatic actuator or the like, although the present disclosure is not limited thereto. As shown in FIG. 2, actuating member 35 is associated with, mounted with respect to and/or in communication with valve 34. In general, when actuating member 35 is actuated, the actuating member 35 then causes valve 34 to open, thereby releasing the fire fighting agent from the first chamber 22 and through the valve 34, as further discussed below.

In exemplary embodiments, actuating member 35 may be actuated either manually or electronically. For example, actuating member 35 typically is associated with and/or mounted with respect to handle member 37. Handle member 37 is configured and dimensioned to allow a user to manually rotate the handle member 37 in order to manually actuate actuating member 35.

Actuating member 35 also may be in communication with and/or mounted with respect to an electric solenoid member 39. In exemplary embodiments, the electric solenoid member 39 is in electrical communication (wired and/or wirelessly) with a sensor and/or switch assembly 41. Typically, sensor and/or switch assembly 41 is located and/or positioned remotely from extinguisher/discharge assembly 10, although the present disclosure is not limited thereto. In general, electric solenoid member 39 is configured and adapted to open when signaled electrically (e.g., via sensor and/or switch assembly 41), and release a small portion of the pressurized fluid (e.g., via a port on the solenoid member 39 connected to a port on the backside of the valve 34) to actuate the actuating member 35, thereby opening valve 34.

Sensor and/or switch assembly 41 may actuate actuating member 35 (via sending signals to electric solenoid member 39) in a variety of ways. For example, a user may manually move or actuate a switch associated with switch assembly 41 to actuate actuating member 35, or a sensor associated with assembly 41 may automatically actuate actuating member 35 by determining when a certain condition has been reached (e.g., when a certain temperature, air or smoke condition has been reached or measured at or near the sensor assembly 41, etc.).

Figure 10:
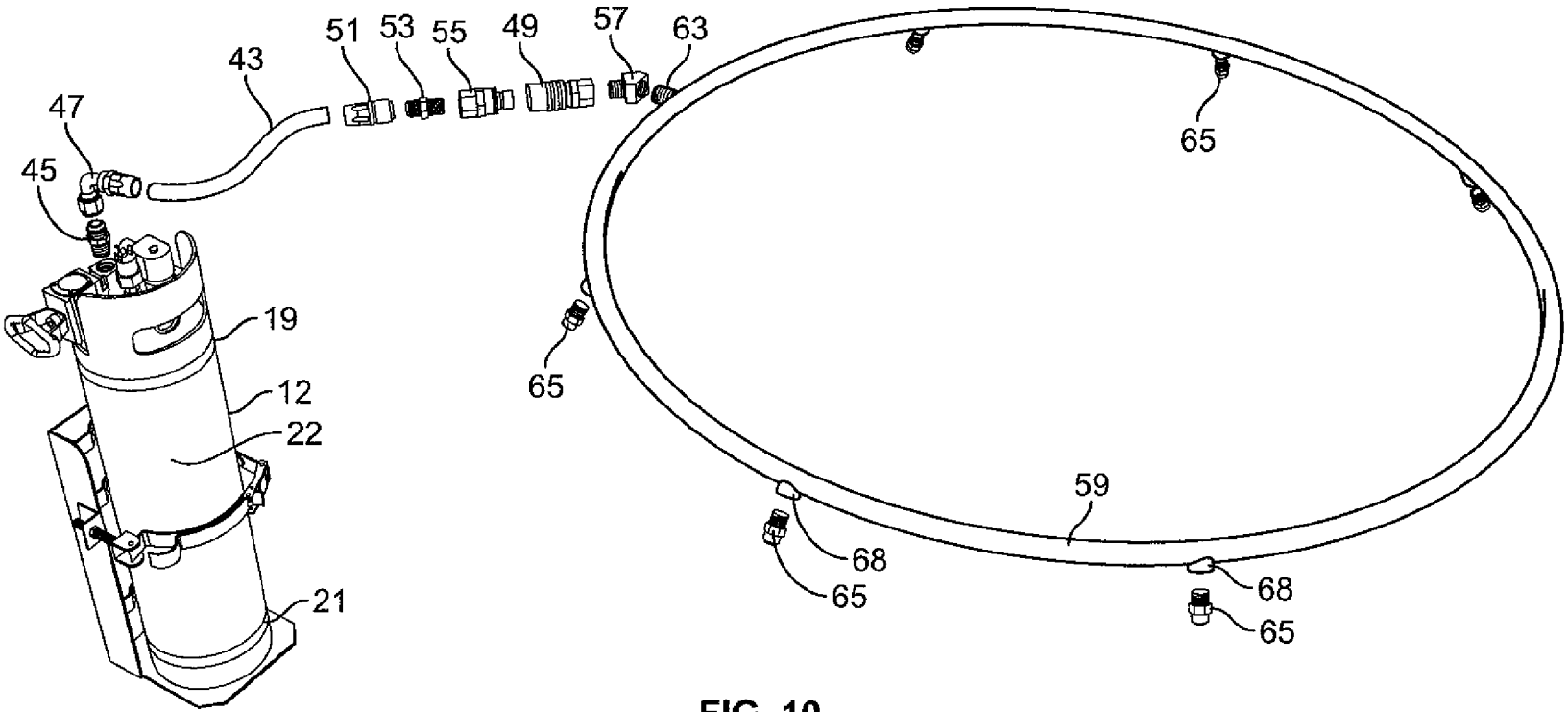
FIG. 10 is a side perspective view of the discharge assembly of FIG. 1 and an exemplary spray assembly according to the present disclosure.

In exemplary embodiments and as shown in FIGS. 1-2 and 10, valve 34 is typically connected to and/or in fluidic communication with a hose member 43 (e.g., braided hose) via fittings 45, 47. The distal end of hose member 43 is typically connected to and/or in fluidic communication with a nozzle or outlet 49 via fittings 51, 53 and plug 55. In exemplary embodiments, nozzle or outlet 49 is a quick disconnect nozzle or the like that is configured and dimensioned to: (i) release, spray and/or discharge the fire fighting agent of first chamber 22 from the nozzle 49 after actuating member 35 has been actuated, or (ii) be releasably and fluidically connected to and/or mounted with respect to a spray assembly 59 (e.g., via connector member 57) to allow the fire fighting agent of first chamber 22 to travel through the nozzle 49 and to spray assembly 59 after actuating member 35 has been actuated. Both of these advantageous features and functionalities of extinguisher/discharge assembly 10 are further discussed below.

In use, when actuating member 35 is actuated or fired (e.g., either manually via handle member 37 or via manual switching system 41, or remotely via electronic sensor system 41, as discussed above), this causes valve 34 to open, thereby allowing for the release of the fire fighting agent from the first chamber 22 and through the valve 34, and the stored fluid pressure (e.g., from the compressed gas or air) in the second chamber 24 moves the actuator 14 (e.g., traveling piston) away from the protrusion 27 and towards the first chamber 22, thereby forcing the fire fighting agent contained in the first chamber 22 out of the housing 12 and through valve 34 and to nozzle 49 of extinguisher/assembly 10. At this point and as discussed above, the fire fighting agent is then either discharged through nozzle 49 to the outside environment for fire fighting purposes, or is transferred to spray assembly 59 for fire fighting purposes.

It is advantageously noted that extinguisher/discharge assembly 10 will fire and/or discharge fire fighting agent regardless of the position of housing 12 relative to gravity due to, inter alia, the actuator 14 (e.g., traveling piston) contained within housing 12, and with the housing 12 having dual pressure chambers (e.g., first and second chambers 22, 24). In other words and unlike conventional extinguishers, extinguisher/discharge assembly 10 will fire and/or discharge fire fighting agent even if the housing 12 of extinguisher/assembly 10 is in a position other than substantially upright relative to gravity. Thus, the present disclosure provides for an improved extinguisher/assembly 10 that is configured to fire or release a fire fighting agent while the housing or cylinder 12 of the extinguisher/assembly 10 is oriented in substantially any position or angle relative to gravity, thereby providing a significant operational and commercial advantage as a result.

In exemplary embodiments and as shown in FIGS. 2-3, when the actuator 14 has reached the top of its stroke (e.g., when the traveling piston is at, near and/or adjacent to first end member 18 at first end 19 of housing 12), a pressure release port 61 of housing 12 is uncovered, thereby allowing substantially any remaining compressed air or gas pressure (e.g., pressurized fluid) in the housing 12 to release therethrough, which thereby forces substantially any remaining fire fighting agent in the first chamber 22 out through valve 34. In one embodiment, pressure release port 61 is about 0.25 inches in width and about 1.75 inches in height, although the present disclosure is not limited thereto.

It is noted that through the use of quick disconnect nozzle or outlet 49, the extinguisher/discharge assembly 10 of the present disclosure has a dual purpose use. For example, nozzle or outlet 49 may be attached, mounted and/or in communication with a spray assembly 59 or the like (e.g., a sprinkler system of a vehicle or building, etc.) for fire fighting purposes, or the extinguisher/discharge assembly 10 may be disconnected (e.g., via quick disconnect nozzle or outlet 49) and then removed from its position or mount from the spray assembly 59 and used as a portable extinguisher (e.g., for other areas inside or outside of the vehicle/building that the spray assembly 59 does not reach appropriately, etc.).

Figure 11:
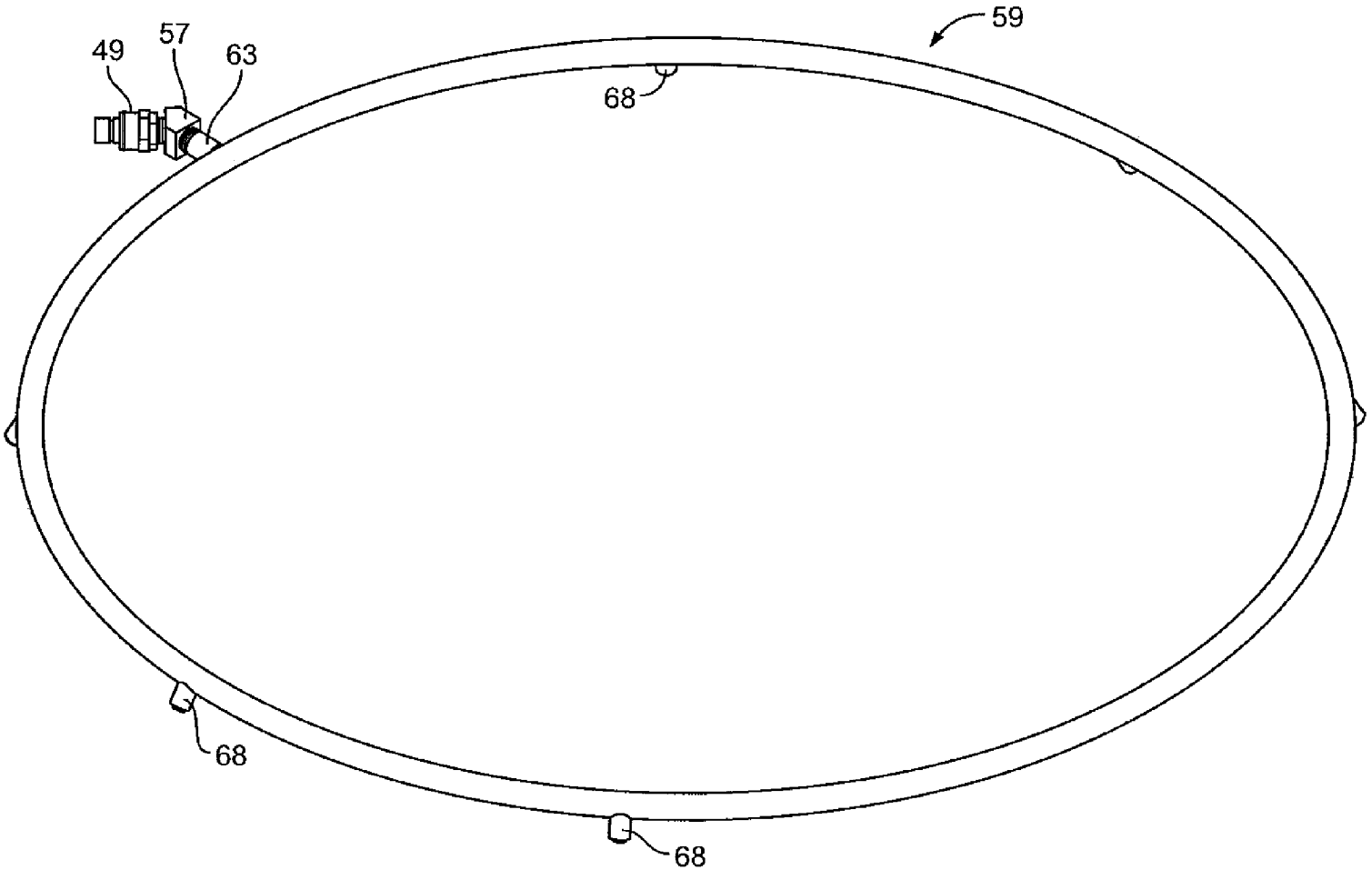
FIG. 11 is side perspective view of the spray assembly of FIG. 10.

In exemplary embodiments and as discussed above, instead of using extinguisher/discharge assembly 10 as a portable and/or stand-alone extinguisher or discharge assembly for the fire fighting agent, extinguisher/assembly 10 may also be releasably connected, secured, attached and/or mounted with respect to spray assembly 59 (FIGS. 10-11). For example, nozzle or outlet 49 may be fluidically connected to and/or mounted with respect to a spray assembly 59 (e.g., via connector member 57) to allow the fire fighting agent of first chamber 22 to travel through the nozzle 49 and to spray assembly 59 after actuating member 35 has been actuated.

In exemplary embodiments and as shown in FIGS. 10-11, exemplary spray assembly 59 takes the form of a spray ring or the like, although the present disclosure is not limited thereto. Rather, spray assembly 59 may take a variety of forms. In one embodiment, spray ring 59 is about 44 inches in diameter, and is fabricated from about 0.50 inch stainless steel pipe. For example, spray ring 59 may be a discharge or fire fighting system (e.g., sprinkler system) for use in a military vehicle having a gun turret or the like, with the spray ring 59 having a varying number of nozzles or outlets 65 (discussed below) installed to provide substantially complete spray coverage of the vehicle occupants, including the gunner of the vehicle.

In general, nozzle or outlet 49 may be fluidically connected or mounted with respect to connector member 57, which in turn is fluidically connected or mounted with respect to inlet 63 of spray assembly 59. Spray assembly 59 is typically in fluidic communication with at least one spray nozzle or outlet 65. The at least one spray nozzle or outlet 65 typically is mounted with respect to an outlet 68 of assembly 59. In exemplary embodiments and as shown in FIGS. 10-11, spray assembly 59 includes a plurality of spray nozzles 65, with each spray nozzle 65 spaced apart from one another for fire fighting purposes.

In use, when nozzle or outlet 49 is fluidically connected and/or mounted with respect to spray assembly 59 and after actuating member 35 has been actuated, the fire fighting agent of first chamber 22 may then travel through valve 34 and to spray assembly 59 and then out through the at least one spray nozzle 65 for fire fighting purposes.

In exemplary embodiments, extinguisher/assembly 10 also includes a carrying handle or the like, and/or mounting hardware or the like (e.g., for mounting extinguisher/assembly 10 to a vehicle or building or the like). As such, extinguisher/assembly 10 can be mounted in a vehicle and actuated via an electronic sensor system and/or manual switching system 41, as discussed above. Additionally and as also noted above, extinguisher/assembly 10 can also advantageously function as a self-contained portable fire extinguisher/discharge assembly.

Figure 12:
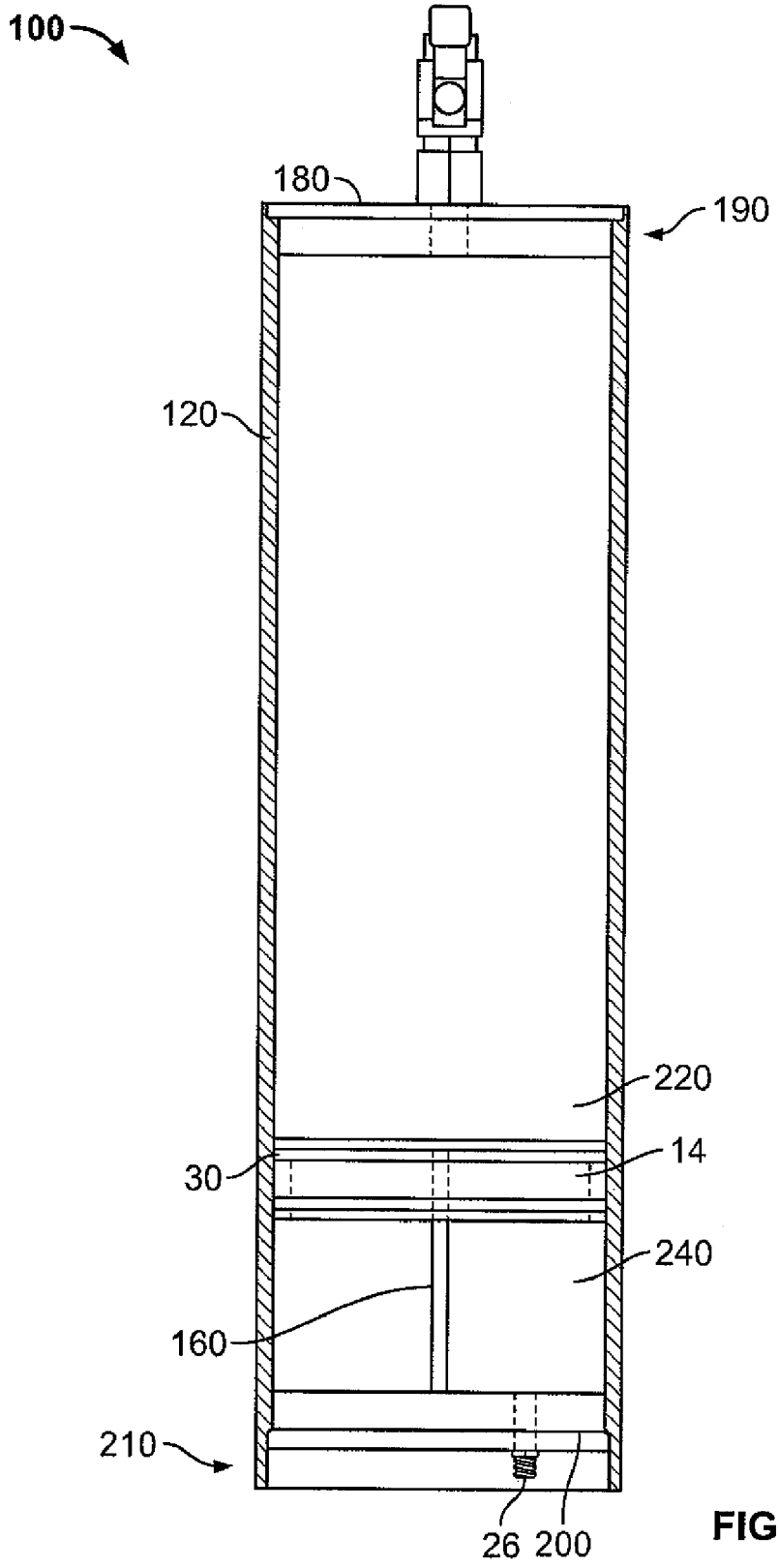
FIG. 12 is a cross-sectional side view of an alternative embodiment of an extinguisher or discharge assembly according to the present disclosure.
Figure 13:
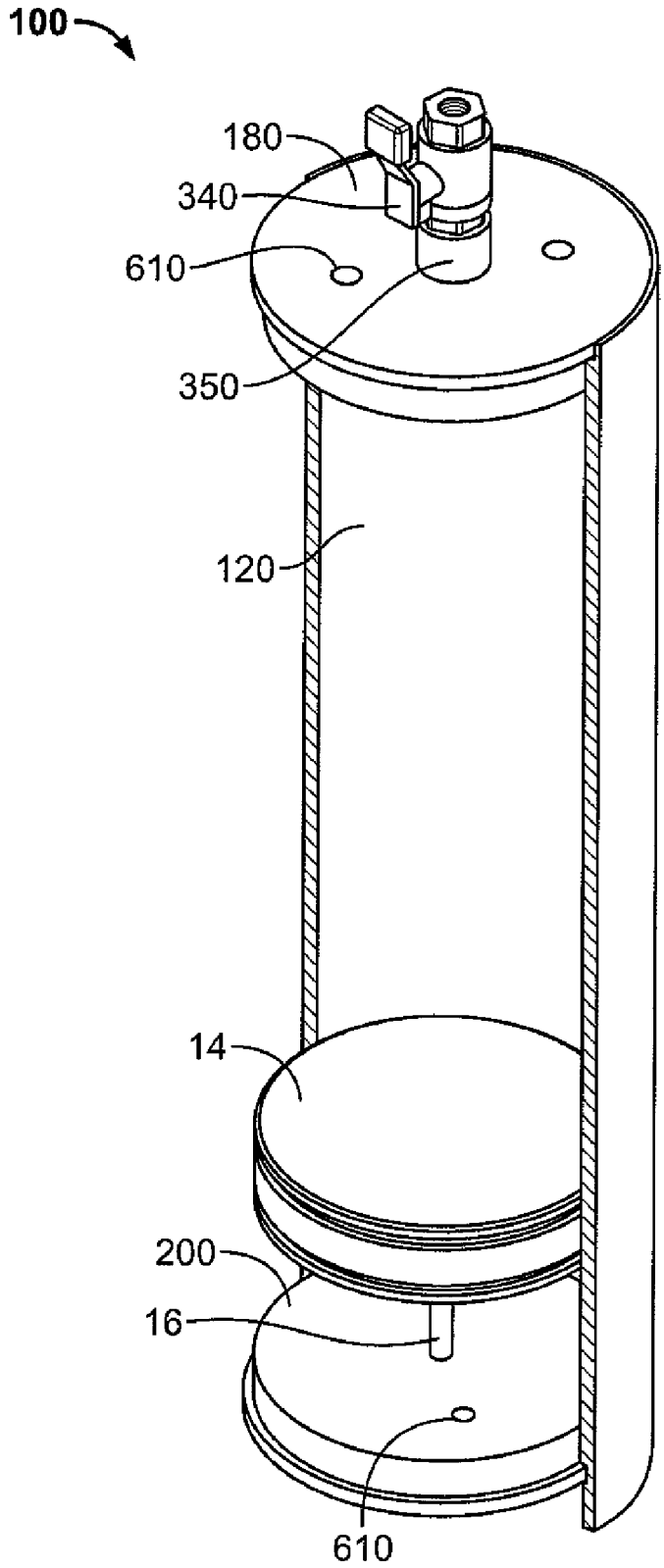
FIG. 13 is a side perspective view of the discharge assembly of FIG. 12, with a portion of the housing removed to show the inner components of the assembly.

In an alternative embodiment and as shown in FIGS. 12-13, extinguisher/discharge assembly 100 also takes the form of a substantially cylindrical or substantially cylinder-based extinguisher or discharge assembly 100, although the present disclosure is not limited thereto. However, it is noted that extinguisher/discharge assembly 100 may take a variety of forms. In general, extinguisher/discharge assembly 100 is a hydro-pneumatic fire extinguisher that is configured and dimensioned to fire or release a fire fighting agent (e.g., a fluid and/or liquid based fire fighting agent) while the housing or cylinder of extinguisher 100 is oriented in any position or angle relative to gravity (e.g., relative to the ground). For example, extinguisher/discharge assembly 100 is configured to house and/or contain about 2 gallons of a fire fighting agent.

As shown in FIGS. 12-13, extinguisher/assembly 100 typically includes housing 120, with housing 120 configured and dimensioned to house and/or contain actuator 14 (FIGS. 7-9). In general, assembly 100 typically includes a first end member 180 and a second end member 200. First end member 180 is typically configured to enclose or seal a first end of housing 120, and second end member 200 is typically configured to enclose or seal a second end of housing 120. In exemplary embodiments, first and second end members 180, 200 are cylindrical (e.g., threaded and/or O-ring based cylinder end caps), and are fabricated from 6061 aluminum or the like. In one embodiment, the threads of first and second end members 180, 200 are configured to threadably engage with threads positioned or located at or near first and second ends 190, 210 of housing 120, respectively. In another embodiment, first end member 180 is threaded and is configured to threadably engage with threads positioned or located at or near first end 190 of housing 120, and second end member 200 is O-ring based, with the second end member 200 having at least one O-ring configured and dimensioned to sealingly engage the housing 120 at or near the second end 210 of housing 120. In one embodiment, first and/or second end members 180, 200 include at least one spanner hole 610, although the present disclosure is not limited thereto.

In general and as discussed above in conjunction with assembly 10, actuator 14 housed within housing 120 is a traveling piston or the like, such as, for example, an ultra high molecular weight polyurethane or an aluminum (e.g., 6061 aluminum) traveling piston 14. In one embodiment, actuator 140 includes or is associated with a dowel or rod 160 (e.g., cylindrical rod) and a dowel or rod stop. Alternatively, housing 120 includes a protrusion or lip (similar to protrusion 27) configured to halt the movement of the actuator 14 when engaged by the actuator 14. For example, the protrusion or lip may be an integral protrusion or lip (i.e., integral with housing 120) positioned or located in the interior of housing 120. The protrusion or lip may also be mounted with respect to the interior of housing 120.

In general and as noted above, actuator 14 is configured and dimensioned to separate housing 120 into two distinct fluid or pressure chambers 220 and 240 (e.g., actuator 14 fluidically separates first chamber 220 of housing 120 from second chamber 240 of housing 120). First chamber 220 is typically configured to house and/or contain a fire fighting agent, and second chamber 240 is configured to house and/or contain a pressurized or compressed fluid or gas (e.g., pressurized or compressed air or nitrogen or the like). In one embodiment, the fluid contained in second chamber 240 is charged to about 300 psi via valve 260. For example, second end member 200 may include valve 260 (e.g., a ⅛ inch NPT Schrader valve).

First end member 180 typically includes valve 340 and port 350 (e.g., ½ inch NPT female port), with valve 340 configured to allow the first chamber 220 to be filled with fire fighting agent and to allow the fire fighting agent to be released when extinguisher/assembly 100 is fired and/or actuated.

Similar to assembly 10, when extinguisher/assembly 100 is fired or actuated (e.g., via actuating member 35 and either manually via a manual handle 47 or switching system 41, or remotely via an electronic sensor system 41, as discussed above), the stored fluid pressure in second chamber 240 moves the actuator 14 towards the first chamber 220, thereby forcing the fire fighting agent out of the housing 120 of extinguisher/assembly 100 via an outlet (e.g., nozzle 49 and/or spray assembly 59). Thus, improved extinguisher/assembly 100 is configured to fire or release a fire fighting agent while the housing or cylinder 120 of the extinguisher/assembly 100 is oriented in any position or angle relative to gravity, thereby providing a significant operational advantage as a result. For example, hydro-pneumatic fire extinguisher/assembly 100 will fire regardless of the position of extinguisher/assembly 100 relative to gravity due to the actuator 14 (e.g., traveling piston) contained within housing 120 with dual pressure chambers (e.g., first and second chambers 220, 240).

Although the devices, systems and methods of the present disclosure have been described with reference to exemplary embodiments thereof, the present disclosure is not limited to such exemplary embodiments and/or implementations. Rather, the devices, systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A discharge assembly comprising:

a housing having a body portion having a first end and a second end, the housing configured and dimensioned to be releasably mounted with respect to a vehicle or structure to allow a user to use the housing in a portable fashion both within or away from the vehicle or structure;

an actuator within the housing, the actuator configured and dimensioned to fluidically separate the housing into a first chamber and a second chamber, the first chamber configured to house a liquid-based fire fighting agent and the second chamber configured to house a pressurized fluid;

a first end member enclosing the first end of the housing and having an outlet in fluid communication with a first valve, the first valve configured to allow: (i) the first chamber to be filled with the liquid-based fire fighting agent, and (ii) at least a portion of the liquid-based fire fighting agent to be released via the first valve when actuated;

an actuating member mounted with respect to the first valve, the actuating member configured to be manually or remotely actuated;

a second valve in fluid communication with the second chamber, the second valve configured to pressurize the fluid housed in the second chamber;

a nozzle in fluid communication with the first valve, the nozzle configured and dimensioned to: (i) discharge the fire fighting agent of the first chamber from the nozzle for fire fighting purposes after the actuating member has been actuated, or (ii) be fluidically and releasably mounted with respect to a spray assembly to allow the fire fighting agent of the first chamber to travel through the nozzle and to the spray assembly for fire fighting purposes after the actuating member has been actuated;

wherein the housing includes an interior protrusion, the interior protrusion configured and dimensioned to allow the actuator to rest thereon prior to actuating the actuating member;

wherein the pressurized fluid in the second chamber is pressurized to about 300 psi or less prior to actuating the actuating member, wherein the first valve is an on/off valve;

wherein upon actuation of the actuating member, the actuating member causes the first valve to open, thereby allowing for the release of the liquid-based fire fighting agent from the first chamber and through the outlet and to the first valve, and the housed fluid pressure in the second chamber moves the actuator towards the first chamber, thereby forcing at least a portion of the liquid-based fire fighting agent out of the first chamber and through the first valve; and wherein at least a portion of the liquid-based fire fighting agent is forced out of the first chamber regardless of the position of the housing relative to gravity.

2. The discharge assembly of claim 1, wherein the body portion of the housing is substantially cylindrical; and wherein the housing further includes a top extension portion that extends: (i) above the body portion, and (ii) at least partially around the circumference of the substantially cylindrical body portion, the top extension portion including a handle slot and a gauge view hole.

3. The discharge assembly of claim 1, wherein the actuator is a traveling piston fabricated from aluminum or ultra high molecular weight polyurethane.

4. The discharge assembly of claim 1, wherein the first end member includes at least one first groove configured to house a first gasketing material that forms a seal between the first end member and the housing; and wherein the actuator includes at least one second groove configured to house a second gasketing material that forms a seal between the actuator and the housing.

5. The discharge assembly of claim 1, wherein the pressurized fluid is selected from the group consisting of compressed gas, air or nitrogen.

6. The discharge assembly of claim 1, wherein the actuator includes a recessed area configured to increase the volume of the second chamber.

7. The discharge assembly of claim 1, wherein the second valve is a Schrader valve; and wherein the first valve is a ½ inch NPT pressure-actuated ball valve.

8. The discharge assembly of claim 1, wherein the first chamber is configured to house about two gallons of the fire fighting agent prior to actuating the actuating member.

9. The discharge assembly of claim 1, wherein the actuating member is a pneumatic actuator.

10. The discharge assembly of claim 1, wherein the actuating member further includes a handle member, the handle member configured to allow a user to manually actuate the actuating member by rotating the handle member.

11. The discharge assembly of claim 1 further comprising an electric solenoid member in communication with the actuating member and in electrical communication with a switch and a sensor, the electric solenoid member configured to: (i) allow a user to actuate the actuating member by manually moving the switch, or (ii) actuate the actuating member when the sensor determines that a certain condition has been reached.

12. The discharge assembly of claim 1, wherein the actuating member further includes manual switching means, the actuating member configured to be manually actuated via the manual switching means; and wherein the actuating member is in electrical communication with sensor means, the actuating member configured to be actuated via the sensor means.

13. The discharge assembly of claim 1, wherein the nozzle is a quick disconnect nozzle.

14. The discharge assembly of claim 1, wherein the spray assembly is a spray ring, the spray ring including at least one spray nozzle.

15. The discharge assembly of claim 1, wherein the spray assembly is configured to be mounted with respect to the vehicle or structure.

16. The discharge assembly of claim 1, wherein the housing further includes a pressure release port; and wherein when the actuator is at the top of its stroke and positioned at or near the first end member at the first end of the housing, the pressure release port is uncovered, thereby allowing substantially any remaining pressurized fluid in the housing to release therethrough, which thereby forces substantially any remaining fire fighting agent in the first chamber out through the first valve.

* * * * *